US007731895B2

(12) United States Patent
Okada et al.

(10) Patent No.: US 7,731,895 B2
(45) Date of Patent: Jun. 8, 2010

(54) AUSTENITIC FE-NI-CR ALLOY

(75) Inventors: Hirokazu Okada, Kobe (JP); Masaaki Igarashi, Sanda (JP); Kazuhiro Ogawa, Nishinomiya (JP); Yasutaka Noguchi, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/905,707

(22) Filed: Oct. 3, 2007

(65) Prior Publication Data

US 2008/0089803 A1 Apr. 17, 2008

Related U.S. Application Data

(63) Continuation of application No. PCT/JP2006/306894, filed on Mar. 31, 2006.

(30) Foreign Application Priority Data

Apr. 4, 2005 (JP) ..... 2005-107469

(51) Int. Cl.

| | |
|---|---|
| ***C22C 38/50*** | (2006.01) |
| ***C22C 38/44*** | (2006.01) |
| ***C22C 38/48*** | (2006.01) |
| ***C22C 30/00*** | (2006.01) |
| ***C22C 19/05*** | (2006.01) |

(52) U.S. Cl. ..... 420/42; 420/43; 420/52; 420/53; 420/54; 420/55; 420/584.1; 420/586.1; 420/452; 420/453

(58) Field of Classification Search ..... 420/42–55, 420/443–448, 451, 453, 43, 584.1, 585, 586, 420/586.1, 452; 148/327, 442
See application file for complete search history.

(56) References Cited

U.S. PATENT DOCUMENTS 4,141,762 A * 2/1979 Yamaguchi et al. ..... 420/40

FOREIGN PATENT DOCUMENTS

| | | | |
|---|---|---|---|
| JP | 37-017113 | | 10/1962 |
| JP | 62-243742 | | 10/1987 |
| JP | 06-228713 | | 8/1994 |
| JP | 07-48655 | * | 2/1995 |
| JP | 07-118810 | | 5/1995 |
| JP | 11-293412 | | 10/1999 |
| JP | 2000-328198 | * | 11/2000 |
| JP | 2001-234297 | * | 8/2001 |

* cited by examiner

*Primary Examiner*—Deborah Yee
(74) *Attorney, Agent, or Firm*—Clark & Brody

(57) ABSTRACT

An austenitic stainless steel improved in creep strength, creep ductility, weldability and also hot workability. The steel, consisting of, by mass %, C: 0.05-0.15%, Si: not more than 2%, Mn: 0.1-3%, P: 0.05-0.30%, S: not more than 0.03%, Cr: 15-28%, Ni: 8-55%, Cu: 0-3.0%, Ti: 0.05-0.6%, REM: 0.001-0.5%, sol. Al: 0.001-0.1%, N: not more than 0.03%, and the balance being Fe and incidental impurities. This steel may contain one or more of Mo, W, B, Nb, V, Co, Zr, Hf, Ta, Mg and Ca. It is preferable that REM is Nd.

4 Claims, No Drawings

AUSTENITIC FE-NI-CR ALLOY

This application is a continuation of International Patent Application No. PCT/JP2006/306894, filed Mar. 31, 2006. This POT application was not in English as published under PCT Article 21(2).

FIELD OF THE INVENTION

This invention relates to an austenitic stainless steel which is excellent in high temperature strength. This stainless steel is useful for tubes of chemical plants, boilers of power plants and, for heat-resistant and pressure-resistant members, such as plates, bars, forged parts and the like.

BACKGROUND OF THE INVENTION

As materials of devices for boilers, chemical plants and the like, which are used in a high temperature environment, austenitic stainless steels such as SUS 304H, SUS 316H, SUS 321H, SUS 347H and SUS310S, which are standardized in JIS, have been conventionally used. However, in recent years the use conditions of these devices, under such a high temperature environment, have become remarkably severe. Accordingly, the required properties for this material have attained a higher level, and the conventional austenitic stainless steels are markedly insufficient in high temperature strength.

Carbides are useful for improving high temperature strength, particularly creep strength of the austenitic stainless steel, and the strength enhancing effect of carbides, such as $M_{23}C_6$, TiC and NbC is practically used. Further improvement of creep strength by the addition of Cu is also applied because the fine Cu-phase, which precipitates during creeping, can contribute to the enhancing of creep strength.

On the other hand, it has been known that P, which is considered as an impurity of the steel, contributes to the improvement of creep strength due to the refining of the $M_{23}C_6$ carbide. For example, Patent Document 1 discloses an invention wherein P is added for enhancing creep strength. However, since increase of the P content deteriorates weldability and creep ductility, the content of P should be restricted. Therefore, it cannot be said that the enhancing effect of the addition of P is fully used.

Patent Document 1: JP Kokai Sho 62-243742

An austenitic stainless steel containing P of more than 0.06%, but not more than 0.20%, is disclosed in Patent Document 2. The steel has been developed for improving the resistance to salt damage under a high temperature environment. Accordingly, it contains an excessive amount of Si, more than 2.0% but not more than 4.0%. Such a large amount of Si promotes precipitation of the σ-phase, and deteriorates the toughness and ductility of the steel.

Patent Document 2: JP Kokai Hei 7-118810

DISCLOSURE OF THE INVENTION

Problem to be Solved by the Invention

The first objective is to provide an austenitic stainless steel which is excellent in not only creep strength but also in creep ductility and weldability.

The second objective is to provide an austenitic stainless steel which is excellent in hot workability in addition to the above-mentioned properties.

Means for Solving the Problem

The inventors have tried to improve creep ductility, weldability and hot workability by adding a small amount of elements to the steel containing P in order to increase high temperature strength.

The inventors investigated elements that improve creep ductility of the austenitic stainless steel containing large amounts of P. As a result, it was found that the addition of very small amounts of REM, particularly Nd, can improve creep ductility remarkably, and also improve weldability and hot workability.

Furthermore, it also has been confirmed that the addition of Ti with P refines carbides and also increases creep strength due to the precipitation of a compound of P during creeping.

The influence of the addition of Cu was also investigated in order to increase creep strength. As a result, it was found that most of the effect of the ductility improvement of REM, particularly Nd, disappears when the content of Cu is more than 3.0%.

The present invention is based on the above-mentioned founding, and it relates to austenitic stainless steels defined in the following (1) to (4).

(1) An austenitic stainless steel consisting of, in percent by mass, C: 0.05-0.15%, Si: not more than 2%, Mn: 0.1-3%, P: 0.05-0.30%, S: not more than 0.03%, Cr: 15-28%, Ni: 8-55%, Cu: 0-3.0%, Ti: 0.05-0.6%, REM: 0.001-0.5%, sol. Al: 0.001-0.1%, N: not more than 0.03%, and the balance being Fe and incidental impurities.

(2) An austenitic stainless steel according to the above (1), which further contains in percent by mass, one or more elements selected from among Mo: 0.05-5%, W: 0.05-10%, but "Mo+(W/2)" is not more than 5%, B: 0.0005-0.05%, Nb: 0.05-0.8%, V: 0.02-1.5%, Co: 0.05-5%, Zr: 0.0005-0.2%, Hf: 00005-1% and Ta: 0.01-8% in lieu of part of Fe.

(3) An austenitic stainless steel according to the above (1) or (2), which further contains in percent by mass, either one or both of Mg: 0.0005-0.05% and Ca: 0.0005-0.05% in lieu of part of Fe.

(4) An austenitic stainless steel according to any one of the above (1) to (3), wherein REM is Nd.

REM is abbreviation for rare earth elements and indicates 17 elements containing fifteen lanthanoid elements and Sc and Y.

The stainless steels of the present invention can be broadly applied as tubes, plates, bars, castings, forged parts and the like, which need high temperature strength and corrosion resistance.

Reasons for the restriction of the contents of the elements will be described below. The term "%" means "% by mass".

C: 0.05-0.15%

C is an useful and important element because it is necessary for obtaining tensile strength and creep strength under a high temperature environment. When the C content is below 0.05%, the positive effect cannot be obtained and high temperature strength cannot reach the necessary level of the steel of this invention. On the other hand, when it exceeds 0.15%, unsoluble carbides increase and C can no longer contribute to the improvement of high temperature strength, and additionally mechanical properties, such as toughness and weldability deteriorate. Accordingly, C content should be 0.05 to 0.15%. A preferable upper limit is 0.13%, and a more preferable upper limit is 0.12%.

Si: not More than 2%

Si is an element that is added for the purpose of deoxidizing molten steel, and it is useful for improving oxidation resistance and steam oxidation resistance. It is preferable that the Si content is 0.05% or more for attaining these effects. However, if the Si content is over 2%, the precipitation of the intermetallic compounds, such as the σ-phase is promoted and therefore the toughness and ductility deteriorate due to the degraded stability of structure at an elevated temperature. Further, weldability and hot workability also deteriorate. Therefore, the Si content should be not more than 2%, and more preferably not more than 1%.

Mn: 0.1-3%

Mn, likewise to Si, has a deoxidizing effect on the steel, and improves the hot workability by fixing S, which is an inevitable impurity of the steel. That is to say that Mn fixes S to form sulfide. In order to attain this effect, an Mn content of not less than 0.1% is essential. However, if the Mn content is over 3%, the precipitation of intermetallic compounds, such as the σ-phase, is promoted and the stability of structure, high temperature strength and other mechanical properties deteriorate. Therefore, the content of Mn should be 0.1-3%. A preferable lower limit and upper limit are 0.2% and 2% respectively. A more preferable upper limit is 1.5%.

P: 0.05-0.30%

P enhances creep strength of the steel of this invention, since P refines carbide and forms precipitates of compounds with Ti and Fe. The content of P should be not less than 0.05% in order to obtain these effects. Although P generally deteriorates creep ductility, weldability and hot workability, this disadvantage decreases in the steel of this invention due to the addition of REM. However, the effects of REM, particularly Nd, decrease when excessive P is contained in the steel. Therefore, the P content should be 0.3% or less. Thus the P content should be 0.05 to 0.3%. A preferable lower limit and upper limit are 0.06% and 0.25% respectively, and a more preferable lower limit is more than 0.08%. A more preferable upper limit is 0.20%.

S: not More than 0.03%

Since S is an impurity that remarkably decreases the hot workability, S should be not more than 0.03%, and the less, the better.

Cr: 15-28%

Cr is an important element, which ensures oxidation resistance, steam oxidation resistance, high temperature corrosion resistance and the like. Furthermore, Cr forms Cr-carbide and increases the strength of the steel. Therefore, Cr should be not less than 15%. The more the Cr content, the more corrosion resistance improves. However, the austenite phase becomes unstable and intermetallic compounds such as the σ-phase and α-Cr phase, which deteriorate toughness and high temperature strength, may form easily when the Cr content exceeds 28%. Therefore, Cr content should be 15 to 28%. A preferable lower limit and upper limit are 16% and 25% respectively, and a more preferable lower limit and upper limit are 17% and 23% respectively.

Ni: 8-55%

Ni is an indispensable element in order to ensure the stable austenite structure. The suitable lower limit of the Ni content is determined by the contents of the ferrite forming elements such as Cr, Mo, W and Nb and the austenite forming elements such as C and N.

Not less than 15% of Cr should be contained in the steel of this invention. It is difficult to obtain the steel wherein the structure is a single phase of austenite, if the Ni content is less than 8% respect to the above-mentioned Cr content. Further, the austenite structure becomes unstable during a long period of use at a high temperature, and brittle phases such as the σ-phase precipitate. Therefore, the high temperature strength and toughness remarkably deteriorate and the steel cannot endure as the heat resistant and pressure resistant members. On the other hand, the effects are saturated and the production cost increases when the Ni content exceeds 55%. Accordingly the Ni content should be 8 to 55%. A preferable upper limit is 25%, and a more preferable upper limit is 15%.

Cu: 0-3.0%

Cu is one of the elements enhancing the creep strength because it precipitates coherently with the austenite matrix as a fine Cu-phase during the use of the steel under a high temperature. When such effects are desired, the Cu may be contained. However, if Cu content is excessive, the hot workability and creep ductility deteriorate. If the Cu content exceeds 3.0%, the effect of the REM for improving creep ductility, which will be mentioned below, decreases. Accordingly, the Cu content should be 0 to 3.0%. A preferable upper limit is 2.0%, and a more preferable upper limit is 0.9%. Although Cu may not be added, the lower limit of its content is preferably 0.01% when the effect for improving creep strength is desired.

Ti: 0.05-0.6%

Ti forms carbide and contributes to the improvement of high temperature strength. In the steel of this invention, Ti, together with P, forms a phosphide that contributes to creep strength. When the Ti content is less than 0.005%, the effect is insufficient. On the other hand, weldability and hot workability deteriorate when the Ti content exceeds 0.6%. Accordingly, the Ti content should be 0.05 to 0.6%. A more preferable lower limit and upper limit are 0.06% and 0.5% respectively.

sol.Al: 0.001-0.1%

In the present invention the content of Al depends upon the content of sol.Al, namely acid-soluble Al. Al is added for deoxidizing of the steel. The content of sol.Al should be not less than 0.001% in order to ensure this effect. However, when the sol. Al content exceeds 0.1%, precipitation of intermetallic compounds such as the σ-phase is promoted and the toughness, ductility and high temperature strength deteriorate. Accordingly, the sol.Al content should be 0.001 to 0.1%. A preferable lower limit and upper limit are 0.005% and 0.05% respectively. A more preferable lower limit and upper limit are 0.01% and 0.03% respectively.

N: not More than 0.03%

In the steel of this invention, which contains Ti, TiN precipitates at a high temperature when N content exceeds 0.03%. The TiN exists in the steel as coarse insoluble nitrides, and it deteriorates the hot workability and cold workability. Accordingly the N content should be 0.03% or less, and the less, the better. A preferable upper limit is 0.02%, and a more preferable upper limit is 0.015%.

REM: 0.001-0.5%

Elements of REM are important for the steel of this invention. The addition of REM can restore the creep ductility and weldability, which are deteriorated by the addition of a large amount of P. REM should be added at a level of not less than 0.001% in order to produce the above effect. However, inclusions such as oxides increase when the REM content exceeds 0.5%. Accordingly, the appropriate range of the REM content is 0.001 to 0.5%. A preferable lower limit and upper limit are 0.005% and 0.2% respectively. A more preferable upper limit is less than 0.1%.

Although the element of the REM can be used alone, a mixture of rare earth elements, such as "mish metal", can also be used. A particularly preferable one is Nd.

One of the steels of this invention is an austenitic stainless steel consisting of the above-mentioned elements and impurities. Another one of the steels of this invention is an austenitic stainless steel containing at least one element, for further increasing the high temperature strength, selected from Mo, W, B, Nb, V, Co, Zr, Hf and Ta. The following are description of these elements.

Mo: 0.05-5%, W: 0.05-10%, but "Mo+(W/2)" is not More than 5%.

Mo and W are not essential for the steel of this invention. However, these elements may be added if necessary, since they are effective in improving the high temperature strength and creep strength. When each of them is used alone, the lower limit of the content should be 0.05%. If they are added together, the lower limit should be not less than 0.05% in total. When Mo content and W content exceed 5% and 10% respectively, the effects are saturated and intermetallic compounds such as the σ-phase are formed and the austenite phase becomes unstable. Accordingly, the hot workability deteriorates. Therefore, when either one or both of Mo and W are used, the upper limits should be 5% for Mo, 10% for W, and 5% for "Mo+(W/2)". The content of W should preferably be less than 4% in order to stabilize the austenite phase, since W is a ferrite forming element.

B: 0.0005-0.05%

B is contained in carbonitrides and also exists as free B along the grain boundaries, and contributes to the fine precipitation of carbonitride. B improves the high temperature strength and creep strength due to the suppressing of the grain boundary slip through the strengthening of grain boundaries. The content of not less than 0.0005% is necessary for these effects. However, the weldability of the steel deteriorates if it is more than 0.05%. Therefore, the B content should be 0.0005 to 0.05%, if it is added. A preferable lower limit and upper limit are 0.001% and 0.01% respectively, and a more preferable upper limit is 0.005%.

Nb: 0.05-0.8%

Similar to Ti, Nb forms carbonitride and increases the creep strength. When its content is less than 0.05%, sufficient effects cannot be obtained. On the other hand, when its content exceeds 0.8%, in addition to the deterioration of weldability and mechanical properties due to an increase of the unsolved nitride, hot workability, and particularly high temperature ductility at 1200° C. or higher, decrease remarkably. Therefore, the Nb content should be 0.05 to 0.8%. A preferable upper limit is 0.6%.

V: 0.02-1.5%

V forms carbide and is effective in order to increase the high temperature strength and creep strength. When its content is less than 0.02%, the effect cannot be obtained. On the other hand, when its content exceeds 1.5%, the high temperature corrosion resistance decreases, and ductility and toughness deteriorate due to precipitation of a brittle phase. Therefore, the V content should be 0.02 to 1.5%. A more preferable lower limit and upper limit are 0.04% and 1% respectively.

Co: 0.05-5%

Co stabilizes the austenite structure, likewise Ni, and also improves creep strength. When its content is less than 0.05%, the effect cannot be obtained. On the other hand, when its content exceeds 5%, the effect saturates and production cost increases. Accordingly, the Co content should be 0.05% to 5%, if it is used.

Zr: 0.0005-0.2%

Zr contributes to grain boundary strengthening and enhancing high temperature strength and creep strength. Furthermore, it fixes S to improve hot workability. Zr content of 0.0005% or more is necessary for obtaining the effects. However, mechanical properties, such as ductility and toughness, deteriorate when its content exceeds 0.2%. Accordingly, the Zr content should be 0.0005 to 0.2%, when it is added. A preferable lower limit and upper limit are 0.01% and 0.1% respectively. A more preferable upper limit is 0.05%.

Hf: 0.0005-1%

Hf is an element that contributes mainly to grain boundary strengthening and also increases creep strength. When its content is less than 0.0005%, the effects cannot be obtained. On the other hand, when its content exceeds 1%, workability and weldability are impaired. Thus the Hf content should be 0.0005 to 1%, when it is added. A preferable lower limit and upper limit are 0.01% and 0.8% respectively, and a more preferable lower limit and upper limit are 0.02% and 0.5% respectively.

Ta: 0.01-8%

Ta forms carbonitride and enhances high temperature strength and creep strength as a solid-solution strengthening element. When its content is less than 0.01%, this effect cannot be obtained. On the other hand, when its content exceeds 8%, workability and mechanical properties are impaired. Accordingly, the Ta content should be 0.01 to 8%, when it is added. A preferable lower limit and upper limit are 0.1% and 7% respectively, and a more preferable lower limit and upper limit are 0.5% and 6% respectively.

Another one of the steels of this invention is an austenitic stainless steel that contains at least one of Ca and Mg in addition to the above-mentioned elements. Ca and Mg improve hot workability of the steel of this invention as mentioned below.

Mg and Ca: 0.0005-0.05% Respectively

Since Mg and Ca form sulfide by fixing S, which impairs the hot workability of the steel, they improve the hot workability. When contents of each are less than 0.0005%, the effects cannot be obtained. On the other hand, Mg and Ca of more than 0.05% respectively deteriorate the steel quality and impair the hot workability and ductility. Accordingly, in the case where Mg and/or Ca are added, the content of each should be 0.0005 to 0.05%. A preferable lower limit and upper limit are 0.001% and 0.02% respectively, and a more preferable upper limit is 0.01%.

The following process is recommendable for manufacturing the steel of this invention.

Ingots are prepared in the conventional melting and casting process for stainless steel. The ingots, as cast or after forging and blooming into billets, are hot-worked in the process such as a hot extrusion or a hot rolling. It is desirable that the heating temperature before the hot working is 1160 to 1250° C. The finishing temperature of the hot working is preferably not lower than 1150° C. It is also preferable to cool the hot worked products at a large cooling rate of 0.25° C./sec or more, in order to suppress the precipitation of coarse carbonitrides.

After the hot working, a final heat treatment may be carried out, however, cold working may be added, if necessary. Carboniterides should be dissolved by heat treatment before the cold working. It is desirable to carry out the heat treatment at a temperature which is higher than the lowest temperature of the heating temperature before the hot working and the hot working finishing temperature.

The cold working is preferably performed by applying a strain of 10% or more, and two of more cold workings may be carried out. The heat treatment for finished products is carried out at a temperature in a range of 1170 to 1300° C. The temperature is preferably higher than the finishing temperature of the hot working or the above-mentioned heat treat temperature by 10° C. or more. It is preferable that the products are cooled, after the final heat treatment, at a cooling rate of 0.25° C./sec or more in order to suppress the precipitation of coarse carbonitrides.

EXAMPLE

Steels having the respective chemical compositions shown in Table 1 were melted by use of a high-frequency vacuum furnace, and cast to produce ingots of 30 kg weight and 120 mm diameter. Steels Nos. 1 to 19 in Table 1 are the steels according to the present invention, and steels A to F are comparative examples.

Each steel ingot was hot-forged to give a plate of 40 mm thickness. In order to carry out a test of hot ductility, a bar test piece of 10 mm diameter and 130 mm length was prepared by machining the plate. The plate was further hot-forged into a plate of 15 mm thickness. After softening heat treatment, the plate was cold-rolled into 10 mm thickness and heated at 1150° C. for 15 minutes and water-cooled.

Pieces for the creep test and the Varestraint test were made from the plates. The creep test piece was a round bar of 6 mm diameter and 30 mm gauge length, and the Varestraint test piece was a plate of 4 mm thickness, 100 mm width and 100 mm length.

Regarding to the test of ductility at a high temperature, after the above-mentioned test pieces were heated at 1230° C. and held for 3 minutes, a high-speed tensile test of a strain rate at 5/sec was carried out, and a reduction of area was obtained from the rupture section. It is known that there are no serious problems in hot working such as hot extrusion when the reduction of area is 60% or more. Accordingly, steels having a reduction of area of 60% or more were considered as the steels having good hot workability.

Using the above-mentioned test pieces, a creep rupture test was carried out in the atmosphere of 700° C. under stress of 147 MPa, and the rupture time and reduction of area after rupture were obtained. Creep strength and creep ductility were estimated from the rupture time and reduction of area after rupture respectively.

The Varestraint test for estimation of weldability was carried out by TIG welding under the condition where heat input was 19 kJ/cm and the applied strain was 1.5%. The weldability was estimated from the total crack length. The results of the above-mentioned tests are shown in Table 2.

TABLE 1

| Steel | Chmical Composition (mass %, Fe:bal.) | | | | | | | | | | | | | |
|---|---|---|---|---|---|---|---|---|---|---|---|---|---|---|
| No. | C | Si | Mn | P | S | Cu | Ni | Cr | Ti | N | Nd | sol.Al | Others | Note |
| 1 | 0.10 | 0.56 | 0.83 | 0.07 | 0.002 | — | 9.2 | 18.9 | 0.27 | 0.008 | 0.006 | 0.019 | | Steel of |
| 2 | 0.10 | 0.57 | 0.99 | 0.11 | 0.003 | — | 9.4 | 19.2 | 0.28 | 0.015 | 0.04 | 0.022 | | this |
| 3 | 0.12 | 0.32 | 1.07 | 0.15 | 0.003 | — | 10.9 | 18.1 | 0.21 | 0.014 | 0.02 | 0.017 | | Invention |
| 4 | 0.18 | 0.55 | 1.08 | 0.20 | 0.003 | — | 9.9 | 18.0 | 0.29 | 0.006 | 0.01 | 0.012 | | |
| 5 | 0.10 | 0.49 | 1.10 | 0.11 | 0.002 | 0.8 | 10.9 | 18.4 | 0.24 | 0.014 | 0.03 | 0.013 | | |
| 6 | 0.08 | 0.26 | 0.63 | 0.12 | 0.003 | 1.7 | 10.4 | 18.9 | 0.16 | 0.015 | 0.02 | 0.026 | | |
| 7 | 0.09 | 0.35 | 0.87 | 0.09 | 0.003 | — | 10.5 | 18.2 | 0.15 | 0.013 | 0.02 | 0.017 | W: 1.5 | |
| 8 | 0.10 | 0.44 | 0.55 | 0.10 | 0.001 | — | 10.4 | 18.7 | 0.26 | 0.008 | 0.04 | 0.021 | Mo: 2.0 | |
| 9 | 0.11 | 0.23 | 1.07 | 0.11 | 0.002 | — | 9.5 | 18.3 | 0.17 | 0.014 | 0.03 | 0.021 | B: 0.002 | |
| 10 | 0.11 | 0.51 | 0.86 | 0.11 | 0.003 | — | 9.2 | 18.3 | 0.27 | 0.008 | 0.01 | 0.030 | Nb: 0.21 | |
| 11 | 0.08 | 0.50 | 1.14 | 0.11 | 0.003 | — | 10.8 | 17.7 | 0.22 | 0.013 | 0.02 | 0.011 | V: 0.29 | |
| 12 | 0.09 | 0.36 | 0.83 | 0.13 | 0.002 | — | 10.1 | 18.4 | 0.23 | 0.009 | 0.02 | 0.008 | Co: 3.2 | |
| 13 | 0.11 | 0.25 | 1.05 | 0.10 | 0.001 | — | 10.2 | 18.3 | 0.21 | 0.007 | 0.03 | 0.023 | Zr: 0.02 | |
| 14 | 0.10 | 0.15 | 0.98 | 0.10 | 0.001 | — | 9.9 | 18.1 | 0.19 | 0.009 | 0.02 | 0.014 | Hf: 0.04 | |
| 15 | 0.12 | 0.31 | 1.02 | 0.08 | 0.001 | — | 12.0 | 18.0 | 0.19 | 0.008 | 0.02 | 0.027 | Ta: 0.83 | |
| 16 | 0.10 | 0.42 | 1.11 | 0.09 | 0.002 | — | 10.3 | 18.5 | 0.22 | 0.008 | 0.01 | 0.023 | Mg: 0.003 | |
| 17 | 0.09 | 0.38 | 0.92 | 0.11 | 0.001 | — | 10.5 | 18.6 | 0.18 | 0.012 | 0.01 | 0.012 | Ca: 0.002 | |
| 18 | 0.10 | 0.33 | 1.05 | 0.11 | 0.001 | — | 10.2 | 18.5 | 0.19 | 0.012 | 0.01 | 0.012 | W: 1.2, Ca: 0.002 | |
| 19 | 0.10 | 0.22 | 0.78 | 0.10 | 0.001 | — | 10.0 | 18.4 | 0.18 | 0.007 | — | 0.022 | La: 0.005, Ce: 0.013 | |
| A | 0.09 | 0.25 | 0.66 | 0.03 | 0.001 | — | 9.9 | 18.7 | 0.19 | 0.011 | — | 0.018 | | Comparative |
| B | 0.11 | 0.37 | 1.19 | 0.05 | 0.002 | — | 9.9 | 18.4 | 0.25 | 0.014 | — | 0.023 | | Example |
| C | 0.09 | 0.54 | 0.60 | 0.11 | 0.002 | — | 9.2 | 17.8 | 0.23 | 0.007 | — | 0.014 | | |
| D | 0.10 | 0.50 | 1.14 | 0.10 | 0.003 | 0.3 | 10.8 | 17.7 | — | 0.013 | 0.02 | 0.015 | | |
| E | 0.12 | 0.41 | 0.91 | 0.09 | 0.001 | 3.2 | 10.3 | 18.7 | 0.25 | 0.011 | 0.02 | 0.017 | | |
| F | 0.11 | 0.37 | 0.83 | 0.35 | 0.001 | — | 10.5 | 19.0 | 0.19 | 0.013 | 0.04 | 0.016 | | |

TABLE 2

| | Result of Creep Test at 700° C., 147 MPa | | | Reduction of Area | |
|---|---|---|---|---|---|
| Steel No. | Rupture Time (hr) | Reduction of Area after Rupture (%) | Varestraint Test Result Total Crack Length (mm) | in High Temprature Ductility Test (%) | Note |
| 1 | 1925 | 66 | 0.6 | 92 | Steel of |
| 2 | 2830 | 64 | 0.9 | 91 | this |
| 3 | 3044 | 59 | 0.8 | 90 | Invention |
| 4 | 3287 | 49 | 1.8 | 90 | |
| 5 | 2761 | 65 | 1.1 | 95 | |
| 6 | 3182 | 43 | 1.1 | 90 | |
| 7 | 3976 | 58 | 0.9 | 87 | |
| 8 | 3420 | 61 | 1.9 | 92 | |
| 9 | 3372 | 69 | 1.3 | 94 | |
| 10 | 3387 | 42 | 1.3 | 85 | |
| 11 | 3891 | 55 | 0.3 | 88 | |
| 12 | 3250 | 53 | 0.5 | 91 | |
| 13 | 3133 | 46 | 0.3 | 94 | |
| 14 | 3049 | 51 | 1.0 | 92 | |

TABLE 2-continued

| Steel No. | Result of Creep Test at 700° C., 147 MPa: Rupture Time (hr) | Reduction of Area after Rupture (%) | Varestraint Test Result Total Crack Length (mm) | Reduction of Area in High Temprature Ductility Test (%) | Note |
|---|---|---|---|---|---|
| 15 | 3065 | 41 | 1.6 | 94 | |
| 16 | 3283 | 56 | 1.7 | 94 | |
| 17 | 3176 | 53 | 1.2 | 96 | |
| 18 | 4025 | 63 | 0.8 | 92 | |
| 19 | 3106 | 49 | 0.7 | 89 | |
| A | 552 | 48 | 0.7 | 86 | Comparative Example |
| B | 1121 | 28 | 3.4 | 65 | |
| C | 2385 | 11 | 5.8 | 55 | |
| D | 982 | 72 | 0.3 | 93 | |
| E | 3006 | 7 | 4.6 | 52 | |
| F | 3159 | 13 | 2.7 | 61 | |

The contents of P were varied in the steels A, B and C of comparative examples. Usually the content of P is restricted to 0.040% or less for the stainless steel for boiler tubes as shown in JIS G3463 for example. Accordingly, the P content of steel A is at the conventional P content level. As shown in Table 2, the creep strength increases with the increase of the P content, however the area of reduction after rupture, weldability and high temperature ductility remarkably decrease.

Steels Nos. 1 to 4 and No. 19 are the steels of this invention. Creep rupture strength of these steels is improved by addition of P, likewise the comparative steels B and C. In these steels, differing from comparative steels, there is no decrease of creep ductility, weldability and high temperature ductility because of the addition of Nd, La and Ce. Further, the creep ductility of these steels is superior to that of steel A, in which the P content remains at the conventional level.

Steel D is a steel used for a comparative example without the Ti addition and contains P and Nd in amounts approximately equal to that of steel No. 2 of this invention. However, its creep properties are not sufficient because it does not contain Ti. Steels Nos. 5 and 6 are further improved in creep strength by the addition of Cu. Comparative steel E contains Cu of more than 3.0%. It is apparent that the excessive amount of Cu impairs the effects of Nd, i.e., effects for improving creep ductility, weldability and high temperature ductility. On the basis of this fact, it can be understood that the Cu content should be not more than 3.0%.

As is mentioned above, the steel of this invention may further contain one or more of W, Mo, B, Nb, V, Co, Zr, Hf, Ta, Mg and Ca. High temperature ductility and creep rupture strength can be further improved by the addition of these elements as shown by steels Nos. 7 to 18.

INDUSTRIAL APPLICABILITY

The austenitic stainless steel, according to the present invention, is remarkably improved not only in high temperature strength but also in hot workability because it contains P and REM, particularly Nd. Further, the steel is excellent in toughness under long period use at high temperatures.

The steel, according to this invention, is useful for heat resistant and pressure resistant members which are used under a high temperature of 650 to 700° C. or higher. In a plant using this steel, the cost of production can be markedly reduced, since the production efficiency can be maintained at a higher level.

The invention claimed is:

1. An austenitic Fe—Ni—Cr alloy consisting of, in percent by mass, C: 0.05-0.15%, Si: not more than 2%, Mn: 0.1-3%, P: 0.10-0.30%, S: not more than 0.03%, Cr: 15-28%, Ni: 8-55%, Ti: 0.05-0.6% REM: 0.001-0.5%, sol. Al: 0.001-0.1%, N: not more than 0.03%, one or more elements selected from among Mo: 0.05-50%, W: 0.05-10%, but "Mo+(W/2)" is not more than 5%, B: 0.0005-0.005%, Nb: 0.05-0.8%, Co: 0.05-5%, Zr: 0.0005-0.2%, Hf: 0.0005-1% and Ta: 0.01-8%, and the balance being Fe and incidental impurities.

2. An austenitic Fe—Ni—Cr alloy consisting of, in percent by mass, C: 0.05-0.15%, Si: not more than 2%, Mn: 0.1-3%, P: 0.10-0.30%, S: not more than 0.03%, Cr: 15-28%, Ni: 8-55%, Ti: 0.05-0.6%, REM: 0.001-0.5%, sol. Al: 0.001-0.1%, N: not more than 0.03%, one or more elements selected from among Mo: 0.05-5%, W: 0.05-10%, but "Mo+(W/2y" is not more than S %, B: 0.0005-0.005%, Nb: 0.05-0.8%, Co: 0.05-5%, Zr: 0.0005-0.2%, Hf; 0.0005-1% and Ta: 0.01-8%, either one or both of Mg: 0.0005-0.05% and Ca: 0.0005-0.05%, and the balance being Fe and incidental impurities.

3. An austenitic Fe—Ni—Cr alloy according to claim 1, wherein REM is Nd.

4. An austenitic Fe—Ni—Cr alloy according to claim 2, wherein REM is Nd.

* * * * *

UNITED STATES PATENT AND TRADEMARK OFFICE

CERTIFICATE OF CORRECTION

PATENT NO. : 7,731,895 B2
APPLICATION NO. : 11/905707
DATED : June 8, 2010
INVENTOR(S) : Okada et al.

It is certified that error appears in the above-identified patent and that said Letters Patent is hereby corrected as shown below:

Column 10, line 35:
"selected from among Mo: 0.05-50%, W:0.05-10%, but "Mo+"
should read:
"selected from among Mo: 0.05-5%, W:0.05-10%, but "Mo+"

Column 10, line 44:
"from among Mo: 0.05-5%, W: 0.05-10%, but "Mo+(W/2y" is"
should read:
"from among Mo: 0.05-5%, W: 0.05-10%, but "Mo+(W/2)" is"

Column 10, line 45:
"not more than S %, B; 0.0005-0.005%, Nb: 0.05-0.8%, Co:"
should read:
"not more than 5%, B; 0.0005-0.005%, Nb: 0.05-0.8%, Co:"

Signed and Sealed this
Twelfth Day of April, 2011

David J. Kappos

David J. Kappos
*Director of the United States Patent and Trademark Office*